United States Patent [19]

Kurata

[11] 3,961,519

[45] June 8, 1976

[54] HAMMER FOR SHEET METAL

[76] Inventor: Yoshio Kurata, 2-17, Joto 5-chome, Kofu, Yamanashi, Japan

[22] Filed: Dec. 19, 1974

[21] Appl. No.: 534,655

[52] U.S. Cl. ..... 72/465; 72/479; 72/481; 72/705; 72/406

[51] Int. Cl.[2] ..... B21D 1/12; B21D 25/00

[58] Field of Search ..... 72/479, 480, 705, 406, 72/76, 477, 395, 465, 466, 469, 481; 173/94, 96, 97

[56] References Cited

UNITED STATES PATENTS

| | | | |
|---|---|---|---|
| 61,334 | 1/1867 | Gordon | 72/406 |
| 2,198,764 | 4/1940 | Edwards | 72/479 |
| 2,623,426 | 12/1952 | Daniels | 72/479 |
| 2,906,150 | 9/1959 | Stewart | 72/465 |
| 2,938,412 | 5/1960 | Walker | 72/479 |

*Primary Examiner*—C. W. Lanham
*Assistant Examiner*—D. M. Gurley
*Attorney, Agent, or Firm*—George B. Oujevolk

[57] ABSTRACT

A hammer for use in sheet metal working has a handle and a hammer head having at one end face a plurality of circumferentially inclined face sections and an adapter having at the rear thereof inclined face sections complementary to the first inclined face sections for causing the adapter to rotate by sliding along both inclined face sections. The hammer head and the adapter are encircled by an elastic tubular sleeve member or coil spring for rotably connecting said head and adapter and for elastically holding said adapter in a return position with respect to the rotation to be caused at the time of striking. On the striking face of the adapter, there may be provided a plurality of projecting stripes.

7 Claims, 9 Drawing Figures

1
2
4
3
5

1
R
Q
7
6
P

4

1
11
3
5

10
8
9
3
5

1
4
3
5

5
12a 5
12a 12b
5

HAMMER FOR SHEET METAL

BACKGROUND OF THE INVENTION

1. Field of the Invention

This invention relates to a hammer for sheet metal, particularly in auto body work, and more particularly, to a hammer wherein, a striking face of the hammer is revolved to exert a circumferentially sliding rotative force onto the face of the work sheet.

2. Prior Art

In sheet metal processing works, e.g., automobile body work, for example in the case of shaping a depressed portion of the outer sheet or plate of the automobile, the sheet can be falttened by placing a dolly in abutment against the inside of the depressed portion and hitting or striking out the depressed portion from the outside with a the hammer, with the outer plate being partially stretched or extended from its original dimension at the time the depression was created. Thus, even after the depression is struck out, the plastic deformation or elongation remains and protrudes sidewards of the sheet face to form a curved shape.

In order to remove this stretch, it is usual to heat and hit such a portion by a wooden hammer or the like and thereafter to cool the sheet metal.

Alternatively, in this striking process in which the work face is hit by the hammer, simultaneously with the hammer blow, the sliding of the hammer along the work face may also take up and relax stretch in the outer sheet.

However, this metal working requires very skilled labor who work by feeling and thus the result of the work may differ according to the technical ability of the worker.

SUMMARY OF THE INVENTION

Generally speaking the present invention contemplates a hammer for sheet metal wherein mounted on one end of the hammer head is an adapter with which the face of the sheet metal is struck, which adapter revolves in abutment against the sheet face at the moment of striking to absorb and relax the stretch of sheet metal to enable the shaping of the sheet metal without heat-treating or other special working or technical ability.

It is another object of this invention to provide an improvement of a sheet metal hammer wherein, on the hammer striking face, a plurality of projecting strips are formed.

Further objects and advantages of the present invention will be aparent from the following description, reference being had to the accompanying drawings wherein a preferred form of the present invention is shown.

BRIEF DESCRIPTION OF THE DRAWINGS

The drawings show an embodiment of a hammer according to this invention.

DETAILED DESCRIPTION OF THE PREFERRED EMBODIMENT

Figures 1, 2, 3, 4, 5, 6, 7, 8, 9:
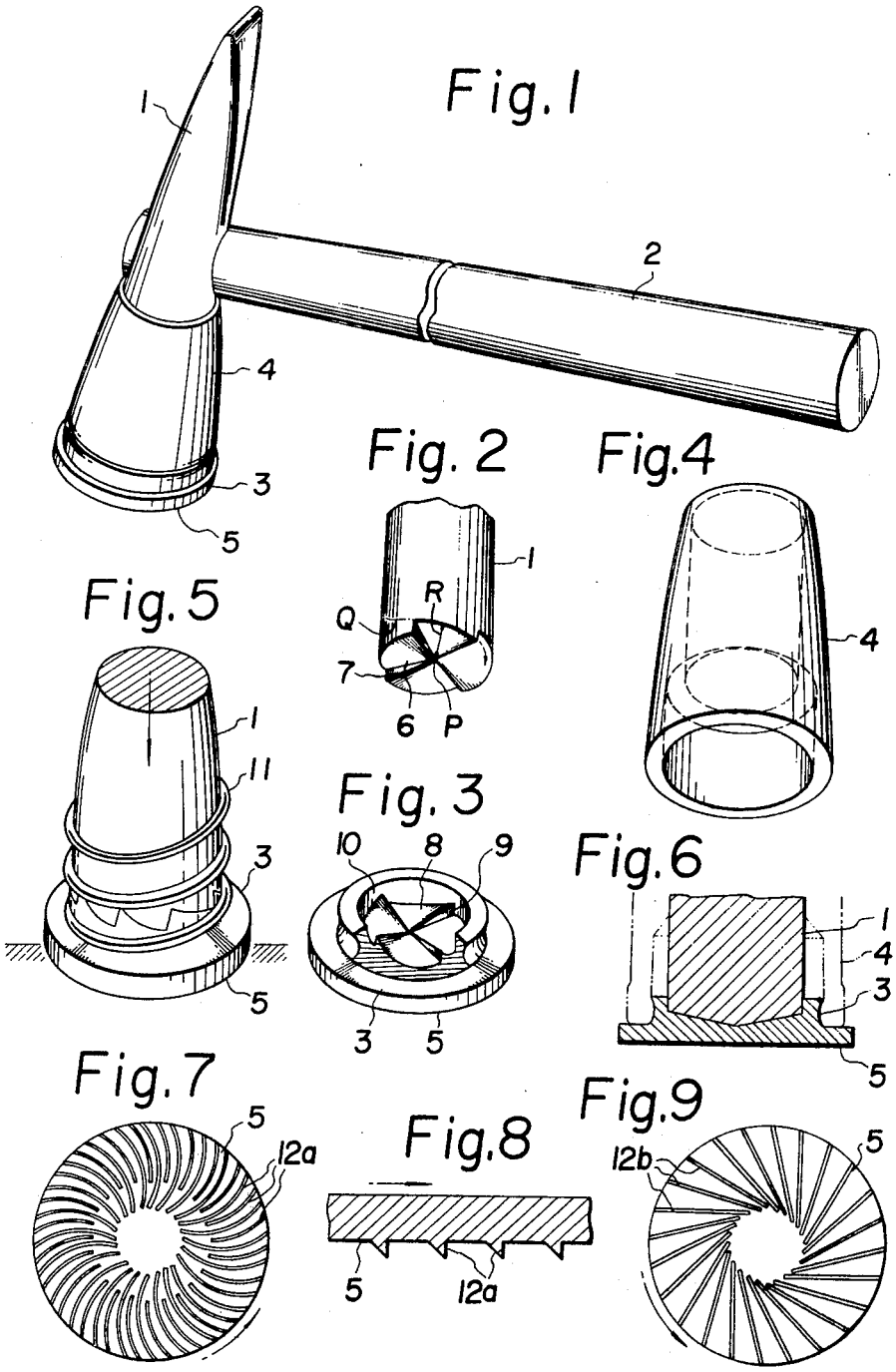
FIG. 1 is a perspective view of the whole of the hammer for sheet metal.
FIG. 2 is a perspective view of one end portion of the hammer body.
FIG. 3 is a partially broken perspective view of an adapter.
FIG. 4 is a perspective view of a connecting member.
FIG. 5 is a perspective view of another embodiment of the connecting member.
FIG. 6 is a cross sectional view of an embodiment wherein a central portion of the end face of the hammer body protrudes outward.
FIG. 7 is a view of projected stripes formed on the striking face of the adapter.
FIG. 8 is a cross sectional view of a sectional configuration of the projected stipes.
FIG. 9 is a view of another embodiment of the projected stripes.

The embodiment of the sheet metal hammer according to this invention will be hereinafter described with reference to the accompanying drawings.

Referring now to FIG. 1, a hammer head 1 has a handle 2 at the middle portion so as to provide a hand grip for striking.

At the end of this hammer head 1, is an adapter 3 is held by a connecting member 4.

On the end of this adapter 3 there is a plane striking face 5.

And, when the user gripping the handle 2 hits striking face 5 against a sheet metal face, the adapter 3 will rotate along the sheet face due to impact force.

In order to obtain such rotation at this blow, the hammer body 1 and adapter 3 are constructed as follows. On the end of the hammer head 1, as shown in FIG. 2, four circumferentially inclined faces 6 are formed. These inclined faces 6 correspond to curved faces formed by fixing a straight line R at one end thereof to a point P on the central axis of the hammer head 1 and by moving the line R at the other end along four imaginary helical curves Q drawn in a relatively low pitch about the outer circumferential face, so that four inclined faces of a concentric circle each sloping circumferentially are formed. Further, the inclined faces 6 are each formed in the region of a right angle (90°) and continue at both ends to triangular faces 7 which are formed axially to provide differential steps. In the meantime, on the rear face of the adapter 3, as shown in FIG. 3, there are inclined faces 8 and vertical faces 9 formed complementary or symmetrically with inclined faces 6 and vertical faces 7 formed on the end of the hammer head 1. Also, the adapter 3 is encircled at the rear face portion thereof by axially protruding side wall 10, within which the end portion of the hammer head 1 is loosely fitted in concentric relation.

The hammer head 1 and adapter 3 are connected by a rubber connecting member 4 that encircles the outer circumferences of side wall 10 and hammer body 1 with the end portion of the hammer head 1 fitted into the side wall 10, this secures the hammer at both ends thereof as shown in FIG. 1.

Connecting member 4 is formed in a tubular shape, as shown in FIG. 4, adapted to be elastically deformed lengthwise and torsionally. The hammer head 1 and adapter 3 are elastically connected and held by said connecting member 4 in a position in which by relatively and coaxially rotating the vertical faces 7 and 9 along the inclined faces 6 and 8 from a position contacting each other, the adapter 3 protrudes out from the hammer head 1 and takes a position which is turned with respect to the rotation to be caused at the time of the blow. Thus, when applying an axial impacting force on striking face 5 of the adapter 3, the adapter 3 may, while sliding on inclined faces 6 and 8, be rotated and retracted and further turned until both vertical faces 7 and 9 are in contact and then stopped. When removing this impacting force, the adapter 3 rapidly returns in rotation due to the elasticity of the rubber connecting member 4 so that the adapter extends to the direction of the end portion to return to its original position.

Therefore, connecting member 4 connects the hammer head 1 and adapter 3 as well as elastically maintaining the adapter 3 in a return position with respect to the rotation to be caused at the time of the blow.

In addition, this rubber connecting member 4 also prevents grease flow out or scatter in all directions on striking, in case there is grease between inclined faces 6 and 8.

FIG. 5 shows another embodiment wherein the hammer head 1 and adapter 3 are constructed similar to the aforementioned embodiment In this embodiment the connecting member 4 is constructed by a spiral spring 11.

This spiral spring 11 is secured at both ends to the hammer head 1 and adapter 3 and connects them for rotation and advance and retreat movements to provide to the adapter 3 a rotation to the return position as in the previous embodiment thus to perform the function as similar to said rubber connecting member 4.

FIG. 6 shows an embodiment wherein inclined faces 6 and 8 formed on the hammer head 1 and adapter 3 of the embodiment illustrated in FIG. 1 are modified in shape.

That is, one of inclined faces 6 of the hammer head 1 and inclined faces 8 of adapter 3 protrudes in the central portion P with respect to the circumferential portion thereof while the other inclined faces are retracted.

Hence, at striking, the projected protruding face may be plunged into the retracted face so that, without shifting of axes, the hitting is stable.

Further, in case the inclined faces 6 and 8 are formed so as to reduce the inclination angle (in the circumferential direction) in the vicinity of vertical faces 7 and 9 in place of having the constant inclination angle as shown in the foregoing embodiment, the inclination angle of contacting faces may be varied in accordance with the advance of the rotative angle so that the rotation can be ensured through a wide range according to the hardness of the material and the strength of the striking force.

Also, as devices for connecting the hammer head 1 and adapter 3 and for providing a rotation to a return position conventional means can be used.

FIGS. 7, 8 and 9 show another embodiment wherein projected stripes are formed on the striking face 5 of the adapter 3 described.

Specifically, on the striking face 5 formed in a circular and plane shape, as shown in FIG. 7, a plurality of arced or curved, projecting stripes 12*a* intersecting at an acute angle with the direction of rotation (shown in arrow) when striking and extending divergently from the central portion to the circumferential portion of the striking face are formed. The cross sectional shape of these stripes 12*a* is formed in a saw-tooth shape in which the tip end is shifted toward the direction of rotation as shown in FIG. 8, resulting in providing powerful friction onto the face of the sheet metal when rotating so as to increase the effects for contracting the metal structures of the sheet face. Also, as the stripes 12 are satisfactory in that these intersect at an appropriate acute angle the direction of rotation, they can be modified in a form of projecting stripes 12*b* extending linearly outwards as shown in FIG. 9. Further, with the hammer body attached to the other end an adapter having a flat and smooth striking face as shown in FIGS. 1, 3, 5 and 6 and also attaching the adapter shown in FIGS. 7, 8 and 9 to an end of the body to complete a single hammer, it is possible to flatten and smooth the struck traces resulting from the stripes by the smooth striking face.

Since the hammer according to this invention is constructed as above, when hitting the sheet face by this hammer, due to the impacting force from the striking face of the adapter, such adapter may be turned by inclined faces so that it may rotate by overcoming the friction with the sheet face and the elasticity of the connecting member. Therefore, at the moment of hitting the object to be shaped in sheet metal works, the adapter causes a rotational movement on the surface to provide a circumferential sliding force against the metal structure of the sheet face. Hence, while it is impossible to remove the stretch produced at the time of creation of the depression in the case of applying merely vertical impact by a conventional hammer, according to the hammer of this invention it provides a powerful circumferential sliding rotative force onto the striking face to draw the metal structure at its circumferential portion into the surface of revolution so that a force for contracting the stretch of the sheet face may act and the stretch can be absorbed and relaxed.

Moreover, by forming stripes on the striking face, it is able to increase the effects increasing the friction against the sheet face to shrink inwards the metal structure of the sheet surface.

While the above-noted embodiments have been described with respect to a hammer having a handle for hand works, this invention is not limited thereto and is also adapted to mechanically apply a repetitive striking by compressed air or other power drive for striking.

Also various modifications within the scope of the invention of the embodiments described and illustrated herein are apparent or will suggest themselves to those skilled in the art.

I claim:

1. A hammer head for working sheet metal to straighten pieces of sheet metal which have been deformed, causing surface bumps and depressions, said hammer head comprising:

a. an elongated hammer head body with a circular front surface piece at the front of said body;

b. a plurality of hammer face sections at said front surface piece, each section extending substantially from the circular center of said circular front surface piece and slanting towards the axis of elongation of said body, each section being similar to the other sections and slanting in the same direction as viewed when traveling around the periphery of said circular front surface piece;

c. a cylindrical adapter in contact with said front surface piece having adapter face sections corresponding to the hammer face sections and in contact therewith; and, d. resilient means holding said adapter and front face pieces in contact, whereby, when said hammer head strikes a workpiece, the adapter face sections slide on the hammer face sections imparting a sliding and turning motion at the time of the hammer blow.

2. A hammer head as claimed in claim 1, wherein said resilient means comprises a tubular elastic sleeve with front and rear ends, secured at said ends to said hammer head body and to said adapter, so arranged as to return said adapter to its original position after turning.

3. A hammer head as claimed in claim 1, wherein said resilient means comprises a spring with front and rear ends secured at said ends to said hammer head body and to said adapter, so coiled as to return the adapter to its original position after turning.

4. A hammer head as claimed in claim 1, wherein said hammer face sections and said adapter face sections are sectors of a circle, said sectors all slanting in the same direction as viewed when traveling around the circular periphery of said front surface piece.

5. A hammer head as claimed in claim 1, wherein the stricking face of the adapter is a plane.

6. A hammer head as claimed in claim 1 wherein said hammer and adapter face sections are a plurality of projecting stripes intersectiong the longitudinal axis at an acute angle and extending outwards.

7. A hammer head as claimed in claim 6, wherein said stripes are arc shaped or curved.

* * * * *